US005614003A

United States Patent [19]

Mallory, Jr.

[11] Patent Number: 5,614,003

[45] Date of Patent: Mar. 25, 1997

[54] METHOD FOR PRODUCING ELECTROLESS POLYALLOYS

[76] Inventor: Glenn O. Mallory, Jr., c/o Electroless Technologies 3860 Cloverdale, Los Angeles, Calif. 90008

[21] Appl. No.: 607,143

[22] Filed: Feb. 26, 1996

[51] Int. Cl.[6] ..... C23C 15/52

[52] U.S. Cl. ..... 106/1.22; 106/1.23; 106/1.26; 106/1.27

[58] Field of Search ..... 106/1.22, 1.23, 106/1.26, 1, 1.27; 427/438, 443.1

[56] References Cited

U.S. PATENT DOCUMENTS

| | | | |
|---|---|---|---|
| 3,432,338 | 3/1969 | Sickles | 117/130 |
| 3,490,924 | 1/1970 | Manson | 106/1 |
| 3,650,803 | 3/1972 | Lin | 106/1.27 |
| 3,667,972 | 6/1972 | Coll-Palagos | 106/1 |
| 3,726,771 | 4/1973 | Coll-Palagos | 204/38 |
| 4,019,910 | 4/1977 | Mallory | 106/1.22 |
| 5,213,907 | 5/1993 | Caballero | 428/678 |
| 5,252,360 | 10/1993 | Huttl | 427/255.2 |
| 5,258,061 | 11/1993 | Martyak | 106/122 |
| 5,338,342 | 8/1994 | Mallory, Jr. | 106/1.22 |
| 5,494,710 | 2/1996 | Mallory | 427/438 |

*Primary Examiner*—Helene Klemanski

[57] ABSTRACT

Method for producing electroless nickel or cobalt polymetallic polyalloys having high hardness as plated and containing phosphorus, a primary metal selected from the group consisting of nickel and cobalt and at least one secondary metal selected from the group consisting of copper, molybdenum, tin, and tungsten, which alloys are prepared in baths employing a hypophosphite reducing agent and operated at a particular alkaline pH range and in the presence of a fluoborate anion. The polyalloys "as-deposited" do not require age or heat treatments to produce hardness having Vickers Harness Number values above about 800 ($VHN_{100}$).

18 Claims, No Drawings

METHOD FOR PRODUCING ELECTROLESS POLYALLOYS

This application is related to U.S. Pat. No. 5,494,710 issuing of Feb. 27, 1996 based upon my co-pending application Ser. No. 08/270,907, filed Jul. 5, 1994.

BACKGROUND OF THE INVENTION

This invention relates to methods for preparing electroless nickel or cobalt polymetallic, polyalloys using electroless preparationable baths for producing polyalloy deposits having improved hardness. More particularly, this invention relates to methods for producing hardness enhanced, electroless nickel or cobalt polyalloy deposits where the preparational baths utilize hypophosphite reducing agents and include a fluoborate for achieving hardness in the plated deposit. The polyalloys of this invention, having such desired hardness, in addition to nickel or cobalt, as the primary metal, contain phosphorus and one or more codeposited secondary metals such as copper, tin, molybdenum or tungsten. The method of this invention produces hard electroless polyalloy deposits "as-plated" which do not require post plating, hardening enhancing procedures such as conventional heat treating or aging to achieve high hardness.

Electroless nickel or cobalt polyalloy plating is an established plating process which provides a continuous deposit of a polymetallic metal coating on metallic or non metallic substrates without the need for an external electric plating current. Such electroless plating process is described generally as a controlled autocatalytic chemical reduction process for depositing the desired metal as a deposit or coating on a suitable substrate and is simply achieved by immersion of the desired substrate into an aqueous polyalloy plating bath solution under appropriate electroless polyalloy plating conditions.

The nickel or cobalt polyalloy deposit produced by electroless polyalloy plating is widely utilized as an engineering coating due to its desirable combination of corrosion and wear resistant properties. As deposited or plated, that is plated electrolessly, an electroless nickel or cobalt polyalloy generally is not hard enough for many applications. When high hardness values, for example as measured with Vickers Hardness Numbers ($VHN_{100}$), are required in excess of from above about 600 $VHN_{100}$, the polyalloy deposit as produced in the electroless plating bath must be subjected to a post plating hardness improvement. Conventionally such hardness improvement is achieved by heating and or aging the deposit to improve its hardness. Such procedures are, however, both complex and time consuming and often are deleterious to certain substrates upon which the electroless polyalloy is deposited by the electroless plating. For example, hard, electroless polyalloy coated, tempered aluminum alloys are desirable for many commercial applications. However, the aluminum alloys coated with the electroless polyalloy cannot be subjected to heat treatment using annealing temperatures in excess of 150° C. which are normally required to harden the polyalloy. At such temperatures the aluminum alloy losses its temper and renders the composite of the polyalloy deposit and the aluminum substrate unsuitable for its intended application. This deleterious effect is also illustrated when the electroless polyalloy is deposited on circuit boards where any annealing temperature required to harden the polyalloy would also injure the plated circuit board substrate.

It has now been discovered, however, that hardness, enhanced electroless polyalloy deposits may be directly achieved "as-plated" without need for any conventional post plating, hardness improving procedures. Such discovery according to the present invention is particularly applicable to polyalloys containing phosphorus, a primary metal selected from nickel and cobalt and at least one secondary codeposited metal selected from the group consisting of copper, molybdenum, tin and tungsten. This meritorious result is readily accomplished according to the method of this invention through use of an electroless nickel or cobalt polyalloy bath which utilizes a phosphorus reducing agent and which contains a fluoborate anion within the bath. This discovery allows a ready and easy procedure for producing hardness enhanced electroless nickel or cobalt polyalloy deposits "as-plated" while utilizing conventional baths with typical procedures and techniques employed for conducting electroless nickel or cobalt polyalloy plating. Moreover, the polyalloy deposits produced from such baths have this unique property of high hardness "as-deposited" with Vickers values above about 800 $VHN_{100}$. These properties make the nickel or cobalt polyalloy deposits uniquely suitable as engineering coatings for such substrates as aluminum or the non-metals substrates employed in circuit boards and eliminate the need to heat or age treat the deposit directly obtained from the bath "as plated" for hardness improvement.

Fluoborates, used in the bath of this invention to achieve high "as plated" hardness, have previously been utilized in electroless nickel or cobalt preparations. For example U.S. Pat. No. 3,490,924 employs nickel fluoborate as the source of the nickel ions and the buffer for controlling bath pH. Also U.S. Pat. No. 3,432,358 discloses use of nickel and cobalt fluoborates as the total metallic sources of the nickel or cobalt ions employed in the acidic electroless bath. Further U.S. Pat. No. 3,726,771 teaches use of nickel fluoborate as a source of metallic nickel in the bath. These uses of fluoborates are not for the hardness improvement of electroless polyalloys "as-plated" according to procedures of the present invention. The conventional methods for hardening electroless polyalloy deposits, such as heat or age treatment, have therefore remained the principle and conventional method of hardening notwithstanding the deleterious disadvantages of such methods.

Accordingly an object of this invention is to provide a method for producing electroless nickel or cobalt polyalloy deposits "as plated" having improved hardness. Another object is to provide a hardness enhanced nickel or cobalt polyalloy deposit prepared according to such method. Still another object is to provide a method for producing an electroless nickel or cobalt deposit having an "as-plated" hardness greater than 800 $VHN_{100}$ where the method employs a fluoborate in the preparational bath. A further object is to provide a hardness improved nickel or cobalt polyalloy deposit "as-plated" having a hardness greater than 800 $VHN_{100}$ prepared according to the method of this invention. These and other objects of this invention will be apparent from the following further detailed description and examples thereof.

The electroless polyalloy bath used in practicing the method of this invention for preparing hardness enhanced, electroless nickel or cobalt polymetallic deposits employs a hypophosphite reducing agent and operates under electroless polyalloy conditions. In its simplest embodiment the method employs a fluoborate within the bath during the electroless reaction to achieve the hardness enhanced nickel or cobalt polyalloy deposit. The fluoborate used according to this invention is present in the bath principally as a fluoborate anion. Generally any source of a fluoborate anion, $BF_4^-$, may be employed which will produce the fluoborate anion in the aqueous electroless bath. The fluoborate source should not, however, interact or interfere with the electroless nickel plating reaction and appropriate water soluble salts or acids such as alkali metal fluoborates or fluoboric acid may be employed. Water soluble salts of the fluoborates are generally preferred such as ammonium and sodium fluoborates which in solution will generate the appropriate fluoborate anion. Another suitable and preferred source is a nickel or cobalt fluoborate which aside from its desirable solubility also adds further nickel or cobalt cations to the bath solution to favor the electroless reaction kinetics. The fluoborate anion should, however, be present in the bath from a source different and separate from the source of the primary metal cations such as nickel or cobalt and from the source or sources of the secondary metals such as copper, tin, molybdenum or tungsten cations. In using the fluoborate according to the method of this invention, the fluoborate anion source such as sodium fluoborate is added to the bath with the other components and generally may be present in the bath solution within the range of from about 0.01 to about 0.6 mols per liter and in preferred ranges to maximize the hardness enhancement of the electroless polyalloy deposit within the range of from about 0.015 to about 0.5 mols per liter or from about 0.015 to 0.04 mols per liter. The electroless polyalloy deposits prepared according to the method of this invention are polymetallic, polyalloys of a primary metal such as nickel or cobalt or mixtures thereof and a secondary metal deposited with the primary metal including at least one metal selected from the group consisting of copper, molybdenum, tin and tungsten. These polyalloys are primarily composed of nickel or cobalt individually or in combination and generally in the range of from about 60 to about 95 weight percent of the alloy. The proportions of the other components of the alloy will vary depending upon the particular secondary metal or metals codeposited with the nickel or cobalt as well as the concentration of the phosphorus element present in the polyalloy. Basically, however, when using conventional techniques the polyalloy may include copper within the range of from about 0.5 to about 4.0 weight percent; tin within the range of from 0.2 to about 10 weight percent; molybdenum within the range of from about 0.6 to about 20 weight percent; tungsten within the range of from about 0.1 to about 27 weight percent; and phosphorus within the range of from about 2 to about 12 weight percent. Usually the polyalloy in addition to phosphorus contains at least two metals as a binary alloy having one primary metal such as nickel and one secondary metal such as molybdenum and examples of the binary alloys include a nickel-copper-phosphorus alloy; a nickel-tin-phosphorus alloy; a nickel-molybdenum-phosphorus alloy; a nickel-tungsten-phosphorus alloy; a cobalt-tin-phosphorus alloy; a cobalt-molybdenum-phosphorus alloy or a cobalt-tungsten-phosphorus alloy. The polyalloys may also contain more than two metals as with three for tertiary alloys or four metals as quaternary alloys and examples include a nickel-copper-tungsten-phosphorus alloy; a nickel-copper-tin-phosphorus alloy; or a cobalt-tungsten-molybdenum-phosphorus alloy.

The electroless polyalloy plating baths according to method of this invention used to produce the polyalloys, except where discussed herein, may generally employ the conventional methods and techniques used in preparing and operating electroless nickel or cobalt polyalloy baths. The baths utilize electroless polyalloy conditions such as temperature and duration for the electroless reaction. In typical procedures an aqueous bath solution is prepared and added to an appropriate electroless plating vessel. Such aqueous bath solution is usually prepared by adding to water the desired bath components including the source of the fluoborate anion such as sodium fluoborate, a hypophosphite reducing agent, a source of the primary metal nickel or cobalt cations for example a salt such as a nickel or cobalt sulfate and a source of the secondary metal cations to be codeposited such as a soluble salt of copper, tin, molybdenum and tungsten. The pH and temperature of the bath are adjusted to the appropriate ranges followed by immersion of a suitable substrate, appropriately pre-cleaned and treated, within the bath so prepared upon which the polyalloy is to be deposited by electroless plating.

The substrate employed for such purpose upon which the polyalloy is coated as a deposit by the electroless plating may be a metal such as aluminum, copper or ferrous alloys or a non-metal such as a plastic or circuit board which may according to established practice be first surface activated. As indicated, however, one of the unique advantages of the bath according to the method of this invention is that it produces a hard deposit "as plated", that is, it does not require further hardening enhancing such as by high temperature annealing to increase the hardness to an acceptable level. This is particularly advantageous for substrates such as aluminum, plastics or printed circuit coatings that cannot be subjected to the high temperatures required for heat annealing electroless polyalloys without deleterious results.

The pH of the bath according to this invention is adjusted within a range of from about 6 to about 13. While the bath may employ such pH range the preferred baths for maximizing the hardness enhancement according to the method of this invention are usually alkaline and within a pH range of from about 8 to about 11 and preferably for a preferred embodiment within the scope of this invention within the alkaline range of from about 8.5 to about 10.5. The pH is controlled in typical procedures by adding a hydroxide to maintain the desired pH range and conventional hydroxides such as sodium, potassium or ammonium hydroxides may be suitably employed for such purposes.

The hypophosphite reducing agent employed in the baths according to this invention may be any of those conventionally used for electroless nickel plating such as sodium hypophosphite. The amount of the reducing agent employed in the plating bath is at least sufficient to stoichiometrically reduce the primary and secondary metal cations in the electroless reaction to free metals and such concentration is usually within the range of from about 0.05 to about 1.0 mols per liter. As in conventional practice the reducing agent may be replenished during the reaction.

The source of the primary and secondary metal cations employed in the electroless plating include any of the water soluble or semi-soluble salts of such metals which are conventionally employed. Any of these metals can be added as soluble salts, salts of low solubility within the particular electroless bath system in which they are intended to be used, esters, or substantially any other source of the primary or secondary metal cations suitable for electroless systems. Typically, suitable sources of the cations are the salts of nickel or cobalt including sulfates, chloride, sulfamates, acetates or other metal salts having anions comparable with these electroless systems. Salts having these same anions usually also provide an acceptable source of cations of the secondary metals including, for example, stannous chloride, stannous fluoborate, sodium stannate, stannous tartrate, cuprous chloride, cuprous sulfate, and cupric salts, sodium tungstate, tungsten dihydrate, and sodium molybdate The cation sources of the secondary metals, and particularly tungsten and molybdenum may be provided in the form of ester complexes of polyhydric compounds which are prepared by conventional techniques involving reaction between an oxyacid and a polyhydric acid or alcohol in accord with the procedures of Malloy, U.S. Pat. No. 4,019,910.

The desired composition of the polyalloy is controlled by the selection of the desired components added to the bath. For example if the alloy is to contain nickel or cobalt or both, then a source of the desired metal cation such as nickel sulfate is added to the bath. In addition to the source of the nickel cation the desired secondary metal cation source or sources are added. For example if the secondary metal is to be copper then copper sulfate is added and if another secondary metal such as tungsten is desired then a source of tungsten cation such as sodium tungstate is added to the bath.

The electroless polyalloy plating conditions employed in conduction the plating will be dependent upon the desired final concentration of the primary metal of nickel or cobalt or secondary metal codeposited with nickel or cobalt in the polyalloy, the various bath components and the particular hypophosphite reducing agent employed as well as the quantity of such reducing agent desired in the polyalloy. Moreover the final composition of the polyalloy and particularly the quantity of the secondary metal codeposited with the primary metal will be a function of the pH range, type and concentrations of the metal cations and temperatures of the bath. Accordingly the conditions as describe herein may be varied somewhat within the indicated ranges to achieve a wide variety of different polyalloy compositions having the desired improved hardness as plated according to the method of this invention.

The concentrations of the metal cations maintained within the bath may be varied but generally sufficient sources of the metal cations within certain preferred ranges. For example, for the primary metals when nickel or cobalt or a mixture is desired in the polyalloy a source or sources of such metal cations should be added to the bath sufficient to provide a concentration of nickel or cobalt cations within the range of from about 0.02 to about 3.0 mols per liter. Similarly for the secondary metals, for example, when copper is desired in the polyalloy; a source of copper cation should be added to the bath sufficient to provide a concentration of cuprous or cupric cations within the range of from about 0.0005 to about 0.01 mols per liter; when tin is desired in the polyalloy, a source of tin cation should be added to the bath sufficient to provide a concentration of stannous or stannic cations within the range of from about 0.0005 to about 0.01 mols per liter; when molybdenum is desired in the polyalloy a source of molybdenum cation should be added to the bath sufficient to provide a concentration of molybdate cation within the range of from about 0.001 to about 0.01 mols per liter; and when tungsten is desired in the polyalloy, a source of tungsten cation should be added to the bath sufficient to provide a concentration of tungstate cation within the range of from about 0.001 to about 0.1 mols per liter.

The baths according to this invention may contain in addition to a hypophosphite reducing agent and the sources of the primary and secondary cations other conventional bath additives such as buffering, complexing, chelating agents or exaltants as well as stabilizers and brighteners. A description of these other suitable additives is recited in Malloy, U.S. Pat. No. 4,018,910.

The temperature employed for the plating bath is in part a function of the desired rate of plating as well as the composition of the bath. Typically the temperature is within the conventional ranges of from about 25° C. to atmospheric boiling at 100° C., although more preferably below 90° C. and typically within the range of from about 30° to 90° C.

The duration of the plating will be dependent upon the desired thickness of the deposit for a given substrate which in turn will be dependent upon the rate of deposition which usually is a function of bath temperature and the particular selection and concentration of bath constituents. Usually, however, the rate of deposition and consequently the duration of the plating within the baths of this invention are similar to those employed conventionally in electroless polyalloy plating baths. Consequently the length of any particular plating will parallel those used for a similar conventional electroless polyalloy bath.

The electroless polymetallic polyalloy deposits produced according to bath of this invention possess a particular combination of unique and desirable properties. Most uniquely and as described herein the electroless polyalloy deposits of this invention possess a high hardness as deposited, that is "as plated" without the conventional heating or age treating at annealing temperatures to achieve the hardness required for many commercial applications.

Such hardness exceeds that normally found in electroless nickel or cobalt polyalloys as plated which in terms of Vickers Hardness ($VHN_{100}$) typically ranges from about 500 to 650 $VHN_{100}$. This is in contrast to those of the present invention which "as plated" is typically above about 800 $VHN_{100}$. As referenced herein and in the Examples hardness is usually characterized as the resistance of a material, in this case electroless nickel, to plastic flow and for thin electroless nickel deposits is conventionally determined using micro hardness testing techniques referenced in the ASTM Test Method 578 "Standard Test Method of Microhardness of Electroplated Coatings". Results are expressed as $VHN_{100}$ numbers with higher values indicating higher hardness recognizing the testing and loading employed in the test methodology.

The following Examples are offered to illustrate the improved electroless polyalloy plating baths of this invention and the modes of carrying out such invention:

A series of electroless polyalloy plating baths were prepared in accordance with conventional procedures using stock solutions prepared for the bath components and utilizing deionized, carbon treated and filtered water and plating grade chemicals. The concentrations of bath components were analyzed by standard, spectrographic, emission and absorption techniques.

The baths were formulated as follows:

Example I
Nickel-Molybdenum-Phosphorus Alloy

| Constituent | Concentration, Mols/Liter (M) |
|---|---|
| Sodium Molybdate | 0.005 |
| Glycine | 0.25 |
| Sodium Citrate | 0.2 |
| Sodium Hypophosphite | 0.20 |
| Nickel Sulfate | 0.1 |
| Sodium Fluoborate, $NaBF_4$ | 0.1 |

Example II
Nickel-Copper-Phosphorus Alloy

| Constituent | Concentration Mols/Liter (M) |
|---|---|
| Potassium Pyrophosphate | 0.30 |
| Glycine | 0.2 |
| Sodium Hypophosphite | 0.3 |
| Nickel Sulfamate | 0.1 |
| Sodium Fluoborate, $NaBF_4$ | 0.03 |
| Copper Sulfate | 0.01 |
| Ammonium Chloride | 0.05 |

Example III
Nickel-Tin-Phosphorus Alloy

| Constituent | Concentration, Mols/Liter (M) |
|---|---|
| Sodium Gluconate | 0.2 |
| Sodium Lactate | 0.2 |
| Sodium Hypophosphite | 0.3 |
| Nickel Sulfamate | 0.08 |
| Nickel Fluoborate, $NiBF_4$ | 0.08 |
| Stannous Tartrate | 0.05 |

Example IV
Cobalt-Tungsten-Phosphorus Alloy

| Constituents | Concentration, Mols/Liter (M) |
|---|---|
| Sodium Citrate | 0.3 |
| Sodium Tungstate | 0.05 |
| Glycine | 0.2 |
| Sodium Hypophosphite | 0.03 |
| Cobalt Sulfamate | 0.06 |
| Cobalt Fluoborate, $CO(BF_4)_2$ | 0.04 |

Example V
Nickel-Tungsten-Phosphorus Alloy

| Constituents | Concentration Mols/Liter (M) |
|---|---|
| Nickel Sulfamate | 0.1 |
| Sodium Citrate | 0.2 |
| Sodium Hypophosphite | 0.2 |
| Sodium Tungstate | 0.1 |
| Nickle Fluoborate, $NiBF_4$ | 0.02 |

Example VI
Nickel-Molybdenum-Phosphorus Alloy

| Constituents | Concentration, Mols/Liter (M) |
|---|---|
| Sodium Molybdate | 0.005 |
| Glycine | 0.1 |
| Sodium Hypophosphite | 0.3 |
| Nickel Sulfate | 0.1 |
| Sodium Citrate | 0.2 |

Example VII
Nickel-Tungsten-Phosphorus Alloy

| Constituents | Concentration Mols / Liter (M) |
|---|---|
| Nickel sulfamate | 0.1 |
| Sodium Citrate | 0.2 |
| Sodium Hypophosphite | 0.2 |
| Sodium Tungstate | 0.1 |

The conditions of the baths were as follows

TABLE I

Bath Conditions

| Example | pH | Temperature, °C. |
|---|---|---|
| I | 10.0 | 87 |
| II | 9.5 | 87 |
| III | 9.0 | 88 |
| IV | 9.0 | 87 |
| V | 8.5 | 87 |
| VI | 10.0 | 87 |
| VII | 8.0 | 87 |

The baths were operated as follows:
Steel panels, cleaned and degreased, were plated in four liter baths containing the constituents shown for the above Examples and at the temperatures shown in the above Table I. The baths constituents were analyzed for concentrations and such constituents were replenished as required according to normal practice during operation of the baths. The pH of the baths was maintained at the value shown in the above Table I by adding a 2.5 molar(M) solution of Sodium hydroxide. After a period appropriate to build up a deposit thickness of about 3 mils, the plating was discontinued and the electroless polyalloy deposits on the steel panels/coupons were analyzed for phosphorus content and content of the primary and secondary metals and tested for Vickers hardness according to ASTM Test Method No. B 578, The results are summarized in the following Table II

TABLE II

| Example | I | II | III | IV | V | VI | VII |
|---|---|---|---|---|---|---|---|
| Hardness $VHN_{100}$ | 900 | 870 | 850 | 910 | 800 | 550 | 625 |
| Nickel Weight, % | 92 | 93 | 94.0 | — | 92.0 | 89.9 | 92.0 |
| Cobalt Weight, % | — | — | — | 90.0 | — | — | — |
| Copper Weight, % | — | 3.0 | — | — | — | — | — |
| Molybdenum Weight, % | 6 | — | — | | — | 8.0 | — |
| Tin Weight, % | — | — | 3.0 | — | — | — | — |
| Tungsten Weight, % | — | — | — | 6.0 | 5.0 | — | 5.0 |
| Phosphorus Weight, % | 2 | 4.0 | 3.0 | 4.0 | 3.0 | 2.1 | 3.0 |

As shown from the data summarized in Table II the hardness of the deposits for Examples VI and VII which were prepared from a bath without a fluoborate anion were less than the hardness of the deposits prepared within the baths of the other Examples which contained a fluoborate anion.

While in the foregoing specification certain embodiments and examples of this invention have been described in detail, it will be appreciated that modifications and variations therefrom will be apparent to those skilled in this art. Accordingly, this invention is to be limited only by the scope of the appended claims.

I claim:

1. A method for producing an electroless polyalloy deposit containing phosphorus, a primary metal selected from the group consisting of nickel and cobalt and at least one secondary metal selected from the group consisting of copper, molybdenum, tin, and tungsten, the improvement of which achieves a hard deposit as plated above about 800 $VHN_{100}$ and comprises preparing the polyalloy in an electroless polyalloy plating bath using a source of hypophosphite ion as a reducing agent and a source of a fluoborate anion wherein the bath is maintained at an alkaline pH.

2. The method according to claim 1 wherein the bath is maintained at a pH range of from about 8 to about 11.

3. The method according to claim 1 wherein the primary metal is nickel.

4. The method according to claim 1 wherein the primary metal is cobalt.

5. The method according to claim 1 wherein the source of the fluoborate anion is present in the bath within the range of from about 0.01 to about 0.6 mols per liter.

6. The method according to claim 2 wherein the bath is maintained at a pH range of from about 8.5 to about 10.5.

7. The method according to claim 3 wherein the secondary metal is copper and the polyalloy produced contains nickel, copper and phosphorus.

8. The method according to claim 3 wherein the secondary metal is tin and the polyalloy produced contains nickel, tin and phosphorus.

9. The method according to claim 3 wherein the secondary metal is molybdenum and the polyalloy produced contains nickel, molybdenum and phosphorus.

10. The method according to claim 3 wherein the secondary metal is tungsten and the polyalloy produced contains nickel, tungsten and phosphorus.

11. The method according to claim 4 wherein the secondary metal is copper and the polyalloy produced contains cobalt, copper and phosphorus.

12. The method according to claim 4 wherein the secondary metal is tin and the polyalloy produced contains cobalt, tin and phosphorus.

13. The method of claim 4 wherein the secondary metal is molybdenum and the polyalloy contains cobalt, molybdenum and phosphorus.

14. The method of claim 4 wherein the secondary metal is tungsten and the polyalloy produced contains cobalt, tungsten, and phosphorus.

15. The method according to claim 1 wherein the source of the fluoborate anion is sodium fluoborate.

16. The method according to claim 1 wherein the source of fluoborate anion is cobalt fluoborate.

17. The method according to claim 1 wherein the source of the fluoborate anion is nickel fluoborate.

18. An electroless polyalloy deposit containing phosphorus, a primary metal selected from the group consisting of nickel and cobalt and at least one secondary metal selected from the group consisting of copper, molybdenum, tin and tungsten, said deposit having a hardness above about 800 $VHN_{100}$ and being prepared in an electroless polyalloy plating bath using a source of hypophosphite ion as a reducing agent and a source of a fluoborate anion wherein the bath is maintained at an alkaline pH.

* * * * *